United States Patent [19]

Doslik

[11] 4,018,064

[45] Apr. 19, 1977

[54] ELECTRONIC CONTROL OF KNITTING MACHINES

[75] Inventor: Peter Raymond Doslik, Stuttgart, Germany

[73] Assignee: Sulzer Morat GmbH, Bonlanden, Germany

[22] Filed: Oct. 18, 1974

[21] Appl. No.: 516,078

[30] Foreign Application Priority Data

Oct. 24, 1973 Germany ..... 2353252

[52] U.S. Cl. ..... 66/154 A; 66/50 R

[51] Int. Cl.² ..... D04B 15/66

[58] Field of Search ..... 66/50 R, 25, 75, 154 A, 66/155; 340/172.5; 235/151.11; 112/79; 139/317

[56] References Cited

UNITED STATES PATENTS

| | | | |
|---|---|---|---|
| 3,831,402 | 8/1974 | Schuman | 66/50 R |
| 3,879,963 | 4/1975 | Grozinger | 66/50 R |
| 3,890,806 | 6/1975 | Grozinger | 66/50 R |
| 3,924,244 | 12/1975 | Seitz | 66/154 A X |

FOREIGN PATENTS OR APPLICATIONS

| | | | |
|---|---|---|---|
| 1,961,021 | 6/1971 | Germany | 66/50 R |
| 2,013,778 | 11/1970 | Germany | 66/50 R |
| 1,196,027 | 6/1970 | United Kingdom | 66/25 |
| 1,324,426 | 7/1973 | United Kingdom | 66/50 R |
| 1,273,661 | 5/1972 | United Kingdom | 66/50 R |

*Primary Examiner*—Ronald Feldbaum

[57] ABSTRACT

Apparatus for the electronic control of a knitting machine of the type comprising a storage device having an information store in which the information of a knitting pattern is stored in block form with every information block containing all the information for one course. The information blocks are broken down into color lines related to the particular colors being knitted, and a distributor mechanism is arranged to feed the color lines to the storage units of a working store, the storage units being associated with respective knitting systems of the knitting machine. The distributor mechanism includes a programming mechanism in the form of a selector matrix controlled by a cross-bar distributor and which determines which knitting system will receive the information for any information block selected from the storage device.

8 Claims, 8 Drawing Figures

ELECTRONIC CONTROL OF KNITTING MACHINES

The invention relates to an apparatus for the electronic control of knitting machines comprising a memory unit with an information storage means, in which the information of a knitting pattern is stored blockwise, such that each information block holds all the information for one course of knitting, moreover a means by which each information block can be broken down into color lines, such that each color line contains all the information about a specific color or property of a course, and a distributor mechanism, by means of which the color lines can be fed to the memory units of a working storage device, which are positively associated with the knitting systems of a knitting machine.

Control systems of the aforementioned type are known from German Pat. OLS No. 2 064 386 and UK Pat. No. 1 373 260 published Nov. 6, 1974 and U.S. Pat. No. 3,924,244. While it is possible with such systems to reproduce patterns of any size, providing the information storage unit is large enough, they do however incur the disadvantage that every knitting system is associated only with one specific color channel. This is determined by the fact that from each information block, a number of color lines corresponding to the number of properties or colors of the pattern is formed and these color lines have to be transferred into the working storage device via the periodically operating distribrutor mechanism, and that the distributor mechanism is provided with only so many color channels as there are properties or colors in the pattern. It is not possible to alter the fixed arrangement existing between the knitting systems and the color channels during the knitting operation.

The relationship between the knitting systems and the color channels can be altered when the machine is stopped, with the aid of so-called color-selector switches, as described in German Pat. OLS No. 2 004 194 and by numeral 67 at page 7, lines 6–29 of British Pat. No. 1,273,661 published May 10, 1972. However, these color-selector switches are capable only of reproducing the pattern in different colors without the need for altering the arrangement of supply packages on the creel. No other changes in the pattern are possible.

The object of the invention is to overcome the disadvantages resulting from the development, checking and continuous production of patterns attributed to the fixed arrangement of the knitting systems to the color channels. The particular object of the invention is to evolve a control mechanism of the above-mentioned type which would however be capable of effecting a free choice of the said arrangement, particularly during the continuous knitting operation.

The invention is characterized in that the distributor mechanism incorporates a programming device by means of which knitting systems can be designated which knitting systems are to be fed with information from any information block selected from the storage unit. Additional features of the invention are described in the sub-claims.

The invention offers the substantial advantage that the knitting systems which are to be fed with the information from an information block or a color line, can be pre-selected by means of a programming mechanism from one information block to another according to the type of program. This offers considerable simplification in knitting technology, in particular in the composing of patterns, because the knitter can freely select whether, with the information from a specific information block, to knit only one course or knit several courses in succession, i.e., the pattern can be extended to a larger number of courses or condensed to a lower number of courses with the necessitating for effecting a change in the information relative to the original pattern as contained in the information storage. Moreover, the fact that with the aid of the programming device incorporated in the invention, it is possible to feed a knitting system with the information of several color lines and that this relationship can be altered periodically, offers important advantages, in particular in the production of three-dimensional patterns.

The invention will now be described in more detail in relation to embodiments and in conjunction with the enclosed drawings.

Figure 1:
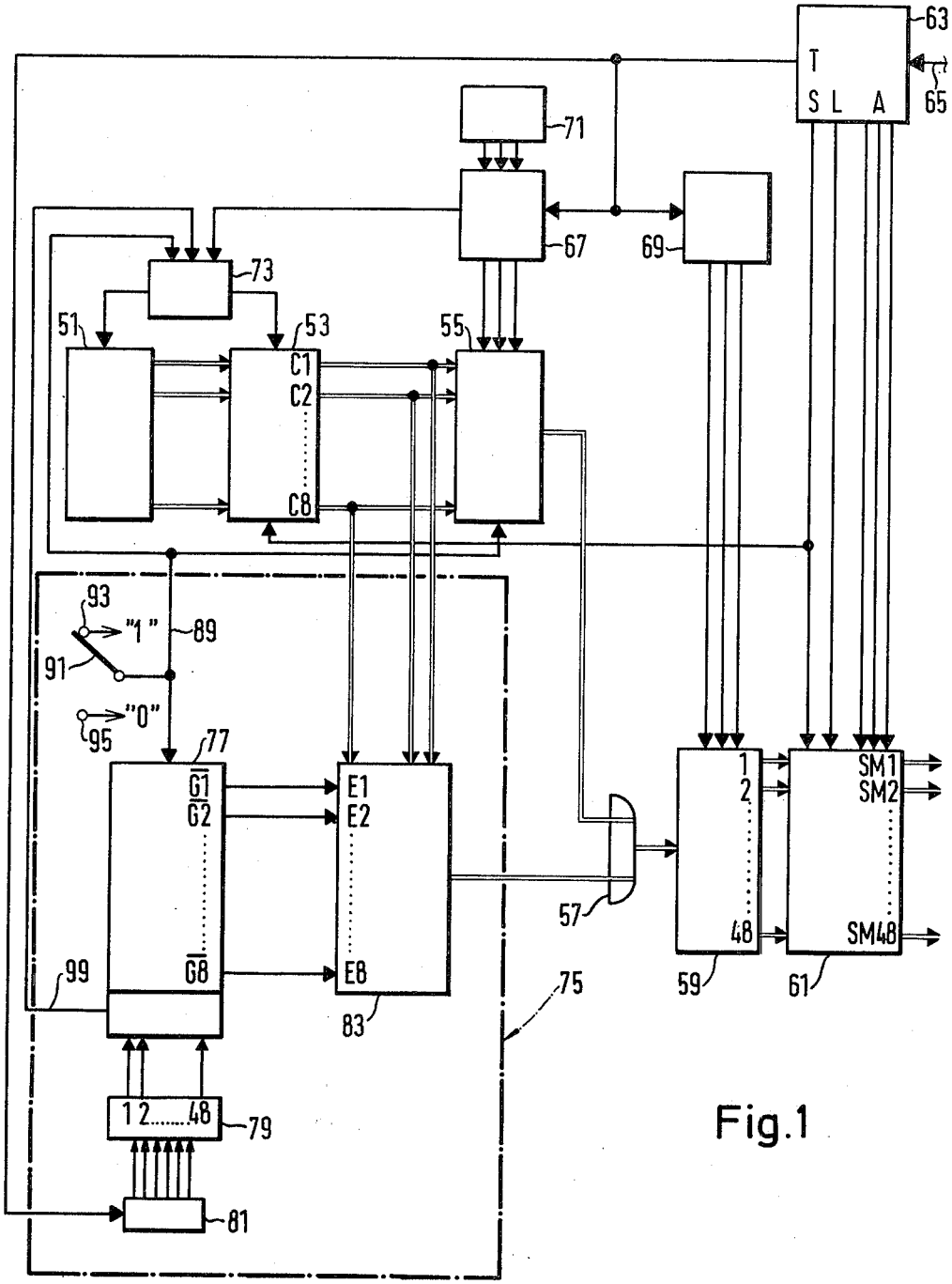
FIG. 1 is a schematic drawing of a control mechanism for knitting machines with programming device according to the invention.

FIG. 1 shows the circuit diagram of a mechanism for electronically controlling a knitting machine. All the information relating to the pattern to be reproduced as required during the continuous knitting operation, is taken from from a storage unit 51, which comprises an information storage unit, for example in the form of a magnetic tape, punched tape or core store or even a film or pattern sketch, and comprising also a device for reading this information. This mechanism is capable of selecting an information block(during the reading operation) which contains all the information required to produce a knitted course, this selection being made from the information storage unit, and then divided this information block into so many color lines as there are colors or properties in the pattern, provision being made for separate outlets in the storage unit 51 for every color line. In the example illustrated, eight outlets are provided so that patterns may be produced in this case containing up to eight colors.

The signals appearing at the outlets or terminals of the storage unit 51 are fed to an intermediary storage 53, having a separate storage unit for each color channel and in which one color line is stored. Terminals C1 to C8 of the intermediary 53 are connected with the eight inputs of a multiplexer 55, the single output of which is connected via an OR gate 57 with the input of a demultiplexer 59, having so many outputs 1 to 48 as there are knitting feeds on the knitting machine. Examples of a multiplexer 55 and a demultiplexer 59 which can be used in the present invention are shown at pages 10 and 15 of Bulletin CB 102 of Texas Instruments Corporation. Outputs 1 to 48 are connected with the inputs of a working storage 61 with equal number of outputs SM1 to SM48, which are conntected to the knitting feeds of the knitting machine. On the one hand, the working storage incorporates all the means necessary to stagger or displace the signals derived from the information storage as stipulated by the interval between the feeds of the knitting machine in question, while on the other hand, for every knitting feed, a storage unit in which a color line is stored such that it can be selected several times in succession during a continuous knitting process, and then can be replaced by a new color line. In FIG. 1, the double lines represent leads through which information is fed while the single lines represent leads through which control signals are fed.

Figure 5:
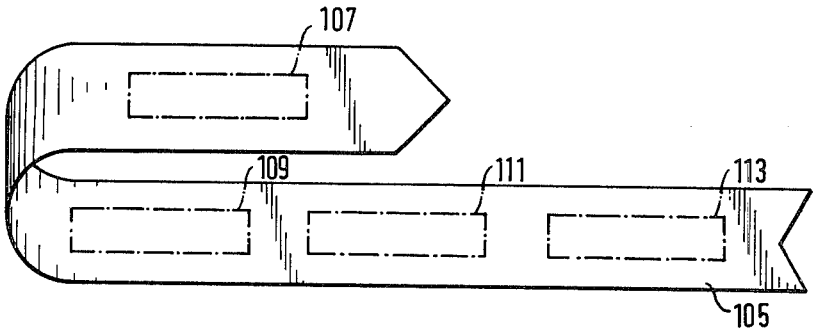
FIG. 5 shows an information storage unit for the knitting pattern of FIG. 4.
Figure 6:
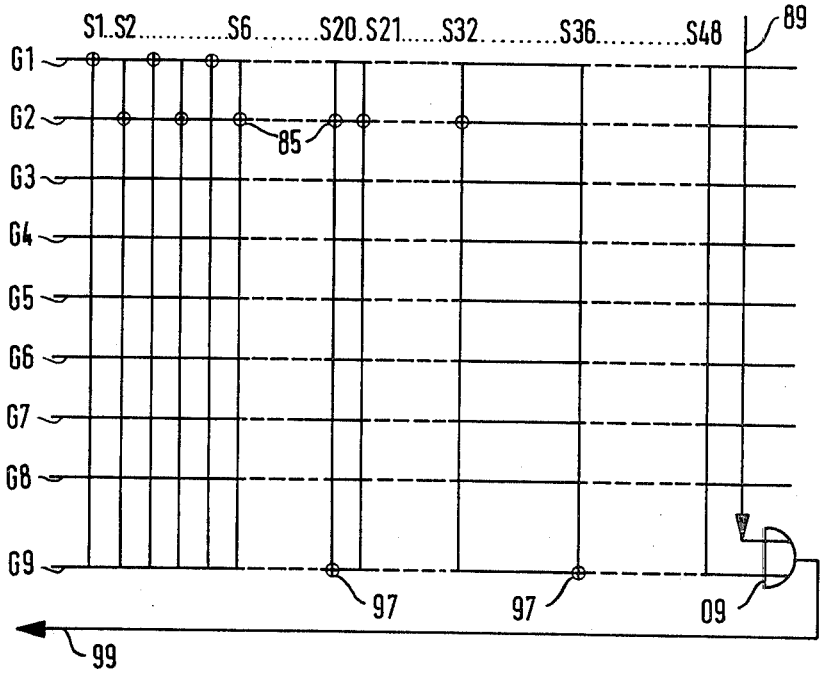
FIG. 6 shows a section of the programming device according to FIG. 2, in the condition necessary to produce the knitting pattern in FIG. 3.

The mechanisms described are controlled from a central unit 63, to which are fed the machine cycle signals, derived from the working speed of the knitting machine. The control unit incorporates counters, addressing stages and impulse generators which can be matched to the prevailing type of knitting machine as shown in U.S. Pat. No. 3,924,244 (FIGS. 5–6*b*).

Outputs S, L and A of the control unit 63 are connected with the working storage 61. Outputs A serve to pass Address signals to the working storage 61, these signals serving during the printing and reading processes to correctly sequence the signals coming from the demultiplexer 59 and to correctly print them into or read them out of the storage units. On the other hand, outputs S and L issue printing and/or reading signals which control the printing or reading operation, whereby the output S is also connected with the intermediate storage 53, for the purpose of controlling the selection of the signals stored therein into the working storage.

Figure 7:
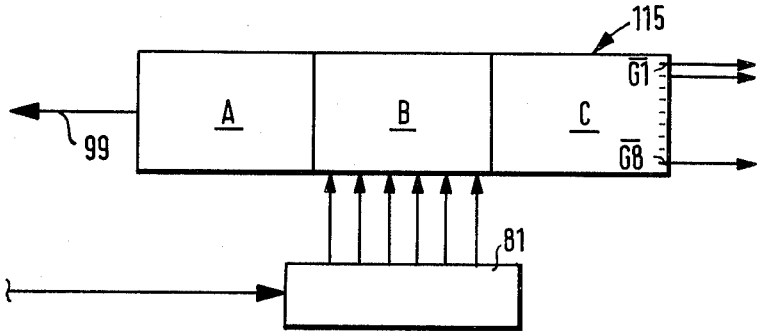
FIG. 7 shows another embodiment for the programming device.

Another output T of the control unit 63 is connected with a color counter 67, attached to the multiplexer 55 and connected with a feed counter 69 attached to the demultiplexer 59. Feed stroke signals are taken from this output T, the time sequence of which corresponds to the spatial distance between the knitting system. Consequently, the output T will always emit a feed stroke signal when a specific needle in the knitting machine reaches a new knitting system during continuous knitting, and consequently, the information of the working storage 61 is to be substituted which is stored in the storage unit associated with this knitting system see shift register 847–849 or core storage 40 of U.S. Pat. No. 3,924,244 (FIGS. 6*b* and 7). The color counter 67 is set by means of a selector switch 71 to that number which corresponds to the number of colors in the pattern. In the example described, the preselector switch 71 has eight selector stages whereas the feed counter 69 has a number of counter stages (viz, 48) corresponding to the number of knitting feeds, so that the input to the demultiplexer 59 is connected by every feed stroke signal with a different one of the 48 inputs to the working storage 61.

Another output from the color counter 67 is connected to the one input of a control circuit 73 which serves to control the selection of the storage device 51 or the feeding of information read from the storage device 51 into the intermediate storage 53, and is consequently connected with control inputs of these mechanisms. Further details can be derived from the German Pat. OLS 2 064 386 and U.S. Pat. No. 3,924,244 (FIGS. 5–66) to which specific reference is made.

The mode of operation of the control mechanism described above is as follows: If for a specific knitting system, the color line located in the relevant storage unit of the working storage 61 is to be substituted by a new color line, then signals will be transmitted from the outputs S and T of the control unit 63, which will transpose the working storage 61 and the intermediate storage 53 into the print state and trip the color counter 67 and the feed counter 69 one step forwards. In consequence, the multiplexer 55 will be switched to the next color feeder while the input to the demultiplexer 59 will be connected with that storage unit of the working storage 61, the color line of which is to be replaced. An exchange of information takes place; the color line located in a storage unit of the intermediary storage 53 is transferred in series via the multiplexer 55 or the demultiplexer 59 to the correct storage unit of the working storage 61 and this could take place between two machine stroke signals.

Once the relevant needle to which the exchange of information refers, reaches the next knitting system, the color counter 67 and the system counter 69 are again tripped one stage further, as a result of which the color lines located in the next storage unit of the intermediary storage 53 are then fed via the now open channels of the multiplexer 55 or the demultiplexer 59 to the particular storage unit of the working storage associated with the just attained knitting system.

Once all the color lines located in the intermediary storage 53 have been read off, the color counter 67 will have reached the counter stage set via the pre-selector counter 71, so that at the next feed stroke signal transmitted by the control unit 63 at the output T, the counter will be zeroed. Consequently, a control signal is transmitted at the output of the color counter 67, associated with the control circuit 73, which will set the storage mechanism 51 to "read" and set the intermediary storage 53 to "print." As a result, before the printing of a new color line into the working storage, a new information block has to be read from the information storage of the storage mechanism 51 and distributed in the form of color lines to the various storage units of the intermediary storage 53 and only then will the color line, from 53, associated with the channel of the output C1 be fed into the working storage 61.

In the embodiment described, a total of eight colors or properties can be fitted, divided into eight different color lines and stored in eight storage units of the intermediary storage 53. Accordingly, the multiplexer 55 has eight channels, connected in series with the input of the demultiplexer 59 under the control of the color counter 67, so that the eight color lines can be fed via eight successively transmitted feed stroke signals from the control unit 63 to the working storage 61. Which of the control units of the working storage will be fed with these eight color lines will depend on the relevant setting of the feed counter 69.

Further details on the working storage 61, the control unit 63, the color counters 67 and the system or feed counter 69, together with their modes of operation are given in German Pat. OLS No. 2 064 386.

In the example described, the knitting machine has 48 feeds so that the outputs 1 to 48 of the demultiplexer 59 are connected one after the other with its input. When using all eight colors, this means that the first information block obtained in each case by the storage device 51, is divided into eight color lines which are fed in succession to the outputs 1 to 8 of the demultiplexer 59, while the eight color lines of the sixth information block in each case are fed via the outputs 41 to 48 into the working storage 61 and from there to the knitting systems or feeds 41 to 48.

By using the multiplexer, the demultiplexer and the relevant counter, a certain color channel is positively associated with each knitting feed. This arrangement can be altered in that provision is made between the storage mechanism 51 and the intermediary storage 53 for a matrix of switches, via which the outputs of the storage mechanism 51 can be linked with preselected inputs of the intermediary storage 53. It will then be possible to vary the colors of the knitting pattern without altering the information in the information storage or the grouping of the supply packages for the yarns being knitting on the machine.

The programming device 75 according to the invention is shown in FIG. 1 by a block, containing various additional blocks including a socket board 77, consisting for example of a crossbar distribution panel, the lead of which can be interconnected as required via diode plugs. The socket board 77 has as many inputs as there are knitting feeds. Every input is linked with an output from the demultiplexer 79, the inputs of which are connected with the outputs of a further system counter 81, corresponding to the systems counter 69 and the feed strok signals transmitted from the output T of the control unit are fed to said counter 81. In addition, the socket board 77 has a total of eight outputs $\overline{G1}$ to $\overline{G8}$ connected with eight corresponding inputs $\overline{E1}$ to $\overline{E8}$ of a selector matrix 83. which in turn has eight further inputs, connected with the eight channels or outputs C1 to C8 of the intermediary storage 53, and one output, connected via the OR unit 57 with the input on the demultiplexer 59.

Figure 2:
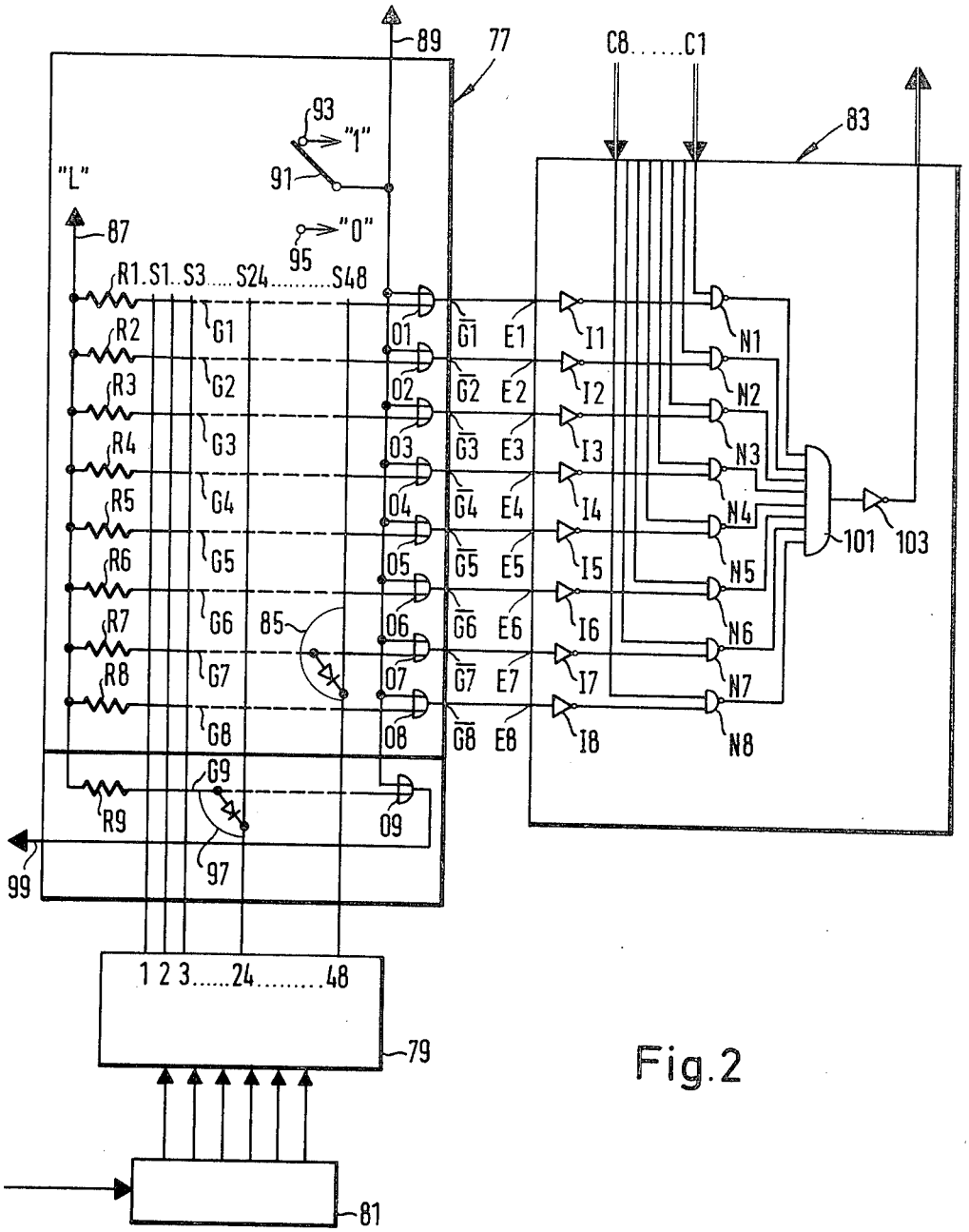
FIG. 2 shows details of the programming device according to FIG. 1

FIG. 2 shows the programming device 75 in detail. The socket board 77 has a crossbar distribution panel with 48 parallel leads S1 to S48., which with aid of diode plugs 85 can be connected to eight additional leads G1 to G8, which on the one side are connected via resistors R1 to R8 with one lead 87, lying at potential "1", corresponding to the binary state "1", and which on the other side, are connected in each case to an input of OR- units 01 to 08. In each case, the second input of these OR units 01 to 08 is connected with a control lead 89 and with the moving contact 91 of a selector switch, which can be switched to and fro between two contacts 93 and 95, such that contact 93 is at a potential "1", corresponding to the binary state "1" and contact 95 is at a potential "0," corresponding to the binary state "0."

As required, leads S1 to S48 may also be connected with further diode plugs 97 to a lead G9, which on the one hand is connected via a resistor R9 with the lead 87 and on the other hand via the one input of an OR-unit 09 of a lead 99, which according to FIG. 1 is connected to a second input on the control circuit 73. To the second input of the OR-unit 09 are connected the lead 89 and the moving tap 91 of the selector switch, while the control lead 89, according to FIG. 1, leads to a further input on the control circuit 73 and on the multiplexer 55.

According to FIG. 2, the outputs of the OR units 01 to 08 are each connected with an inverter 11 to 18 of the selector matrix 83. The outputs of these inverters 11 to 18 are each connected with an input of a NAND-unit N1 to N8, the outputs of which lie at the eight inputs of an AND-unit 101. The output of this AND unit 101 is connected via an inverter 103 (according to FIG. 1) with the OR unit 57, while every second input of the NAND units N1 to N8 are connected with the outputs C1 to C8 of the intermediary storage 53.

The mode of operation of the above-described programming device 75 is as follows:

The arrangement is such that the output of the inverter 103 is always at a potential "0," corresponding to the binary state "0," unless special conditions prevail, because the output of a NAND unit N1 to N8 can be at the potential "0" only if its two inputs receive an "L" signal. This condition cannot be attained if the moving contact 91 makes with contact 93 and consequently the programming mechanism 75 is switched off, because in that case, via the reversal stages I1 to I8, there would be a reverse potential to the value "0"; nor if the moving contact 91 makes with the contact 95 and thereby the programming mechanism 75 is switched on, although all lines G1 to G8 have a potential "1", which occurs if no diode plug 85 is inserted. The condition "1" at the output of the inverter 103 corresponds to an instruction "non-knit," since every "1" impulse at one of the outputs C1 to C8 of the intermediary storage 53 also corresponds to the instruction "non-knit", whereas "0" impulses correspond to the instruction "knit." If necessary, by omitting the inverter 103, the point could be reached that a signal reversal takes place, relative to the signals at the outputs of the intermediary storage 53.

Every second input of the OR units 01 to 08 can be given a potential "0" if required by using diode plugs 85, since the demultiplexer 79 is of such a type that an output of the demultiplexer 79, depending on the counting stage of the feed counter 81, and consequently also the associated leads S1 to S48 will assume the potential "0." If this lead is connected via the diode plug 85 with selected leads G1 to G8, then the selected leads will be changed from the potential "1" to the potential "0." If then the first inputs of the OR units 01 to 08 have a potential "0," because the moving contact 91 is switched to contact 95, then the outputs of selected OR units 01 to 09 will each transmit "0" signals or the output of the subsequent inverters I1 to I8 will transmit "1" signals.

All those NAND units N1 to N8, each second input of which has a potential "1" in consequence of this, will then always transmit a "0" signal at its output if an "1" signal is also fed to its second input. In the example described, this will always be the case if an "1" signal appears at one of the outputs C1 to C8 of the intermediary storage 53; this "1" signal corresponds to the non knit instruction.

The consequences of this particular programming are obvious. once the information block has been converted from color lines into the intermediate storage and when a control signal is transmitted from the control unit 63 via the output S, the printing process commences for the working storage 61 with respect to a specific knitting system. During this printing process, it will not be a particular color line which will be established by the operation of the multiplexer 55 and the demultiplexer 59, i.e., printed into the working storage 61 instead, selected color lines will be transferred into the working storage 61, and in fact only one selected color line or several selected color lines of any color channels may be involved. By means of the programming device 75, all those outlets C1 to C8 of the intermediate storage 53 are connected with the OR unit 57 alternatively, via the mutliplexer 55, with the storage unit of the working storage 61, associated with the particular knitting system, said outputs C1 to C8 being connected to NAND units N1 to N8, the one input of which having the "1" potential.

By way of example, the information of the third knitting system is to be replaced at a given time, so that the third output of the demultiplexer 79 will have a potential "0," while all other outputs will remain with potential "1". For example, lead S3 is linked via a diode plug 85 with the leads G3 and G5, so that in each case the one input of the NAND units N3 and N5 will have the potential "1", while the corresponding inputs of all other NAND units N1 to N8 will remain at potential "0" or their outputs will remain at potential "1". The result of this will be that the output of the AND unit 101 will always be at potential "1" and the output of the inverter 103 will always be at condition "0," as long as "0" impulses (corresponding to knit instructions) appear at the outputs C3 and C5 of the intermediate storage. If however, "1" impulses (corresponding to non knit instructions) appear at one of the outputs C3 or C5, then these impulses will have the effect that a "0" signal will appear at the output of the NAND unit N3 or N5 or an "1" signal will appear at the output of the inverter 103. Consequently, the storage unit of the working storage 61, associated with the third knitting system, will be fed all those signals which in the information storage of the storage mechanism 51, associated with the third and fifth color channel/feeder.

When the programming mechanism 75 is switched on, the control circuit 73 will be tripped by the signal appearing in the control lead 89 such that it can be operated only by control signals which appear in the lead 99. The times at which control signals appear in the lead 99 and therefore when a new information block is printed into the intermediate storage 53, can be selected at will on the programming mechanism 75 according to the invention, with the aid of diode plugs 97. If for example, the circuit S24 is connected with circuit G9 via a diode plug 97, then control signals will always appear when there is a potential at the output 24 of the demultiplexer 79, corresponding to the condition "0." If the circuit G9 is connected with several circuits S1 to S48, then several signals will be generated before the output 1 of the demultiplexer 79 is again at the "0" potential and the program sequence is repeated.

Figure 3:
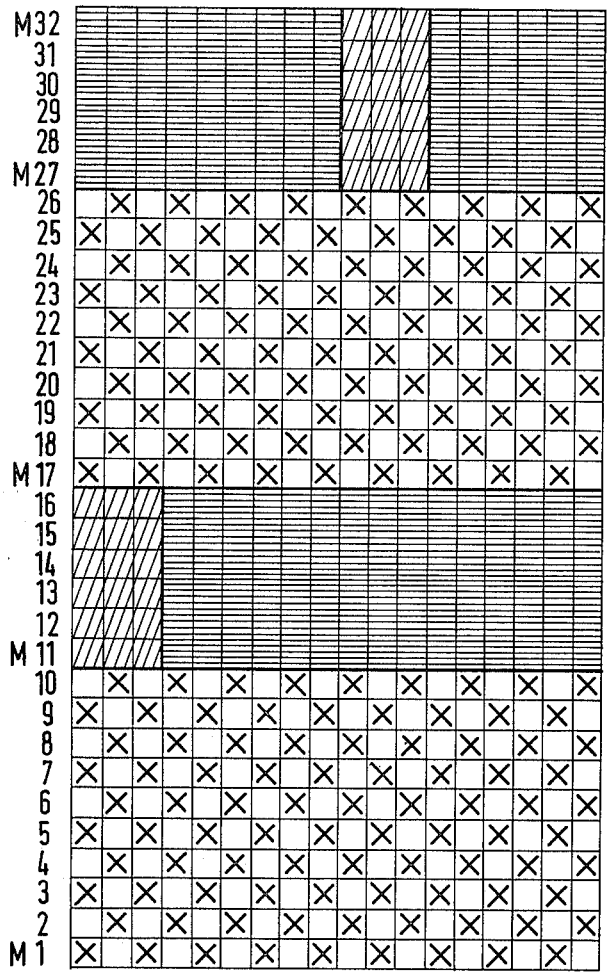
FIG. 3 shows complete knitting pattern.

A particular embodiment of the patterning potential offered by the programming mechanism according to the invention is illustrated in FIGS. 3 to 6. FIG. 3 shows a pattern with a width of 18 wales and a height of 32 courses, which can be reproduced on a standard circular knitting machine, having 36 feeds, the pattern being made during two revolutions of the needle cylinder. During the first revolution, yarns are knitted in interlock pattern in feeds 1 to 20, in that in each of the first of two adjacent feeds, the 1st, 3rd, 5th, etc., needle is selected and in every second of the adjoining pairs of feeds, the 2nd, 4th, 6th, etc., needle is selected. During the first revolution of the cylinder, brown yarn is knitted in feeds 21 to 32 on the first three needles, while the brown yarn is underlaid at the next fifteen needles. During the next revolution of the cylinder, feeds 1 to 20 knit as in the first revolution, while the brown yarn is underlaid at the first nine needles at feeds 21 to 32; the brown yarn is knitted at the next three needles and then underlaid again at the next six needles. The brown sections of the pattern, knitted on groups of three needles protrude as a relief pattern from the otherwise smooth pattern.

In the past, the electronic control of a circular knitting machine which is to reproduce the described pattern, would require an information storage, containing information for every stitch included in the pattern illustrated in FIG. 3, i.e., $18 \times 32 = 576$ instructions. When using the programmer 75 according to the invention, the information storage will require to contain only the information for the pattern shown in FIG. 4, i.e., $18 \times 4 = 72$ instructions. The indicated pattern courses M1, M11, M17 and M27 correspond to the pattern courses similarly indicated in the pattern of FIG. 3.

Figure 4:
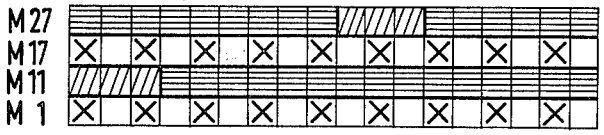
FIG. 4 shows that section of the knitting pattern of FIG. 3 which is required for controlling the knitting machine in application of the invention.

For example, to reproduce the pattern shown in FIG. 3 with the aid of the given pattern information, a program carrier 105 (as in FIG. 5) is used as information storage, on which four information blocks 107, 109, 111 and 113 are stored, each of which contain all the information for each of the courses M1, M11, M17 and M27, as schematically illustrated in FIG. 4. That is, the leads or circuits S1 to S20 are alternately connected with circuits G1 and G2 with the aid of diode plugs 85, while circuits S21 and S32 are connected to circuit G2. Moreover, circuits S20 and S36 are connected via diode plug 97 with circuit G9. The mode of operation is therefore as follows:

At the start of the knitting process, the information block 107 is printed into the intermediary storage 53, which merely has one color line in each of the color channels according to the output C1 and C2, such that the one color line contains one instruction, corresponding to "knit" for every 1st, 3rd, 5th, etc, needle and the other color line contains the instructions for the 2nd, 4th, 6th, etc., needle. The result of this is that in the storage units of the working storage 61, associated with the knitting systems 1 to 20, the one or other color line is stored. When a "0" potential appears at the output 20 of the demultiplexer 79, the control circuit 99 passes a control signal, as a result of which the information block 109 is printed into the intermediate storage 53. In the color channel pertaining to the output C2, the information block 109 will always contain knitting instructions for the first three needles or 'non-knit' instructions for the next 15 needles.

Following a complete revolution of the needle cylinder indicated by a control signal in the line S36 and/or in the control circuit 99, the information block 111 is transferred to the intermediate storage 53, such that the processing of this information block 111 is the same as the processing of information block 107. Finally, corresponding to the information block 109, the information block 113 is then processed, the latter containing only knitting instructions for the 10th to 12th needles, before the pattern is repeated after a total of two revolutions of the needle cylinder.

If required, the pattern shown in FIG. 3 can be varied in that the diode plugs 85 or 97 can be reversed. For example, if circuits S1 to S10 are alternatively connected with the color channels corresponding to the outputs C1 and C2, while the circuits S11 to S32 were connected with the color channel corresponding to the output C2, and finally, if circuits S10 and S36 were connected with the control circuit 99, then the resultant knitting pattern would differ from the one illustrated in FIG. 3 in that overall, only 10 courses would make up an interlock pattern and 22 courses make up the raised pattern. Similarly, raised or three dimensional patterns can be produced in that the information from several color channels are fed to one particular system as a result of which double stitches would be produced.

Figure 8:
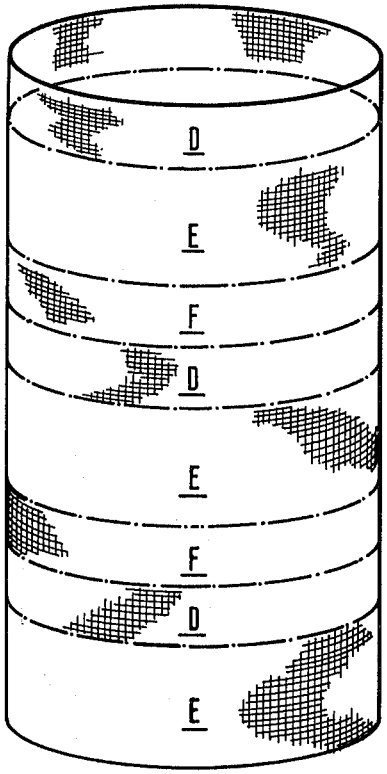
FIG. 8 shows a knitted pattern produced with the programming device shown in FIG. 7.

The range of possible patterns can be extended in that the number of circuits is increased from S1 to S48; the embodiment shown in FIG. 7, instead of having a socket board 77, it has a freely programmable storage 115 with eight outputs $\overline{G1}$ to $\overline{G8}$, corresponding to the outputs $\overline{G1}$ to $\overline{G8}$ of the socket board 77 and at which, in the desired sequence, appear the signals programmed in the storage 115 for the preparation of selected NAND units N1 to N8 (FIG. 2). These signals may be grouped into zones A, B and C, associated with specific sections of the knitgoods, so that for example, a knitted tube can be knitted as shown in FIG. 8, the pattern of which consists of three zones D, E and F. All these zones are reproduced with one and the same information storage of mechanism 51 and differ from each other only in that the knitting systems in each zone D, E and F are associated with other color channels, predetermined by the zones A, B and C of the information storage. According to the invention, the distribution mechanism thus involves, as a significant component, a programming mechanism 75, with which it is possible to determine which knitting system will process the information from any information block selected from the storage mechanism. As a result, the following effects can be obtained:

1. The allocation of a color line to those knitting systems or conversely, the allocation of a knitting system to a color line can be selected at will.

2. Information from any number of color lines can be fed to every knitting system, i.e., the association between knitting systems and the color channels can be selected at will.

3. Due to the fact that one of the circuits S1 to S8 is not connected with one of the circuits G1 to G8, any one of the knitting systems can be disengaged and thereby cut out of the knitting process.

4. There is complete choice as to how many knitting systems will participate in the formation of a course. When knitting with a certain number of colors, it is not essential, for example, for a corresponding number of knitting systems to partake in the knitting of a course, as a consequence of which, a very wide variety of constructions can be produced.

5. There is complete choice as to how often every single color line can be selected in succession from the intermediate storage 53, i.e., every color line or every information block can be used to produce only one or alternatively a plurality of courses.

6. Color lines may contain information relating to colors, constructions, yarn materials and other properties of the pattern.

The programming mechanism according to the invention is preferably designed as an ancillary, so that it can be incorporated with any knitting machine as desired.

What we claim is:

1. Apparatus for the electronic control of a knitting machine having knitting systems for knitting a fabric, said apparatus comprising: a storage device including an information store, in which the information of a knitting pattern can be stored in block form with every information block containing all the information for one knitted course of said fabric, and including means for producing color lines for deriving color lines from every information block, each color line containing all the information relating to a particular color or property of one of said courses; and further comprising a plurality of storage units, a distributor means for feeding the color lines derived by said color lines produced means to said plurality of storage units, the storage units being positively associated with said knitting systems and said distributor means including a programming means for feeding the color lines derived from each information block to any pre-selected number of the plurality of storage units and for feeding each color line derived from an information block to any preselected storage unit of said number of storage units.

2. An apparatus according to claim 1, wherein said distributor means includes a temporary storage (53) for separately storing all color lines derived from one information block and having as many outputs (C1 – C8) as there are color lines derivable from one information block, said outputs being connected via said programming means with said storage units of said working storage.

3. An apparatus according to claim 1, wherein said programming means includes a selector matrix (77) having as many outputs as there are color lines derivable from said information blocks, each output being connected with a control input of a gating means (N1 to N8) for opening or closing said gating means, and having as many inputs as there are knitting systems, said inputs being coupled to a system stroke counter (81), and wherein each gating means has a second information input coupled to receive one of said color lines derived from every information block.

4. An apparatus according to claim 2, wherein said programming means includes a selector matrix (77) having as many outputs as there are color lines derivable from said information blocks, each output being connected with a control input of a gating means (N1 to N8) for opening and closing said gating means, and having as many inputs as there are knitting systems, said inputs being coupled to a system stroke counter (81), and wherein each gating means has a second information input coupled to an associated output of said temporary store.

5. An apparatus according to claim 3, wherein the control inputs of said gating means are coupled to a cross bar distributor means, said cross bar distributor means being said selectable matrix.

6. An apparatus according to claim 3, wherein the control inputs of said gating means are coupled to a freely programmable store.

7. An apparatus according to claim 3, wherein said gating means have an output coupled to a demultiplexer means (59), which has a plurality of outputs each output being connected with one associated storage unit of said working storage.

8. An apparatus according to claim 7, said working storage being coupled to said knitting systems and having a staggering means for bringing the information into a sequence as it is necessary for the knitting process.

* * * * *